US012256852B2

(12) United States Patent
Trapasso

(10) Patent No.: US 12,256,852 B2
(45) Date of Patent: Mar. 25, 2025

(54) RELEASABLE BRACKET FOR FASTENING TO SLOTTED WALL PANEL AND MOUNTING SYSTEM

(71) Applicant: Philip E. Trapasso, North Smithfield, RI (US)

(72) Inventor: Philip E. Trapasso, North Smithfield, RI (US)

(73) Assignee: Tasso Research, LLC, North Smithfield, RI (US)

( * ) Notice: Subject to any disclaimer, the term of this patent is extended or adjusted under 35 U.S.C. 154(b) by 75 days.

(21) Appl. No.: 18/232,057

(22) Filed: Aug. 9, 2023

(65) Prior Publication Data

US 2024/0049893 A1 Feb. 15, 2024

Related U.S. Application Data

(60) Provisional application No. 63/396,817, filed on Aug. 10, 2022.

(51) Int. Cl.
*A47F 5/08* (2006.01)

(52) U.S. Cl.
CPC ..... *A47F 5/0823* (2013.01)

(58) Field of Classification Search
CPC ..... A47F 5/0823
USPC ..... 248/220.21, 220.31
See application file for complete search history.

(56) References Cited

U.S. PATENT DOCUMENTS

| | | | | |
|---|---|---|---|---|
| 4,205,815 | A * | 6/1980 | Sauer | E04B 2/789 248/222.51 |
| 4,211,379 | A * | 7/1980 | Morgan | A47B 96/067 52/36.5 |
| 5,205,524 | A * | 4/1993 | Cohen | F16B 7/14 248/222.51 |
| 6,591,995 | B1 * | 7/2003 | Grove | A47F 5/0815 211/87.01 |
| 8,240,625 | B2 * | 8/2012 | Kato | B60R 7/10 248/224.7 |
| 8,297,572 | B2 * | 10/2012 | Fox | A47F 5/0823 248/222.51 |
| 10,300,862 | B2 * | 5/2019 | Sotome | F16B 5/126 |
| 10,687,617 | B2 * | 6/2020 | Davis | A47B 96/061 |
| 10,827,853 | B2 * | 11/2020 | Ma | E05B 65/00 |
| 11,258,157 | B2 * | 2/2022 | Ai | F16M 13/02 |
| 11,291,314 | B2 * | 4/2022 | Wengerd | A47F 5/0006 |
| 11,498,502 | B2 * | 11/2022 | Nozaki | F16L 3/13 |
| 11,992,135 | B2 * | 5/2024 | Bullwinkel | A47F 5/0006 |

* cited by examiner

*Primary Examiner* — Todd M Epps
(74) *Attorney, Agent, or Firm* — Feeney IP Law; Daniel W. Sullivan; Alan F. Feeney

(57) ABSTRACT

The present invention provides releasable brackets that can fasten to mounting panels. The invention also includes wall mounting assemblies. The brackets can be inserted into vertical slots in the mounting panel. The mounting panel can be mounted to a wall. The brackets are securely fastened to the mounting panel but can be removed if needed. The brackets have an outwardly extending arm that can be used to support and hold various items such as hand tools, power tools, utensils, and the like.

15 Claims, 7 Drawing Sheets

RELEASABLE BRACKET FOR FASTENING TO SLOTTED WALL PANEL AND MOUNTING SYSTEM

CROSS-REFERENCE TO RELATED APPLICATION

This application claims the benefit of U.S. Provisional Patent Application No. 63/396,817, filed Aug. 10, 2022, the entire disclosure of which is hereby incorporated by reference.

BACKGROUND OF THE INVENTION

Field of the Invention

The present invention generally relates to releasable brackets that can fasten to a mounting panel (which may also be referred to as a board). The brackets can be inserted into slots, e.g., vertical slots, in the mounting panel. The mounting panel may be mounted to a wall. The brackets are securely fastened to the mounting panel but can be removed if needed. The brackets may have an outwardly extending arm that may be used to support and hold various items such as hand tools, power tools, utensils, and the like.

Brief Review of the Related Art

In recent years, wall mounting systems having brackets or other support structures have become more popular. These systems typically include a wall mounting panel containing slots or grooves. Brackets having various connectors are inserted into the slots. The connector, which is positioned on one end of the bracket, secures the bracket to the panel. The other end of the bracket may contain a hook or other structure for retaining an article such as hand tools, power tools, lawn and garden supplies, and the like.

For example, Bodkin, U.S. Pat. No. 1,938,370 discloses relates to hangar bars for displaying and carrying different products, particularly automotive gaskets. The hangar bar is laced through the slot and the upper and lower notches are in vertical alignment and the upper end of the hangar bar is first inserted to clear the lower end in the slot. The hangar bar is forced downwardly until the bottom edge of the slot fits snugly into the notch.

Sauer et al., U.S. Pat. No. 4,205,815 discloses a shelf bracket adapted to be secured to an upright by means of a bracket clip. The bracket may be used to support shelves and the like. The bracket is secured to the upright by means of a clip-flange. The clip flange is provided with a slit such that it fits within the slot of the bracket and secures the bracket at a particular height.

Morgan, U.S. Pat. No. 4,211,379 discloses a mounting fixture which is constructed to mate with a panel board having lateral grooves cut therein. The fixture is mounted on the panel board by manual insertion. The uppermost free end of the fixture is manually inserted into a groove. Then, the fixture is rotated downwardly until the lower portion of the fixture engages another groove.

Cohen, U.S. Pat. No. 5,205,524 discloses an adjustable bracket. The planar strap-shaped bracket inner body includes upper and lower shoulders with an inner or locking end thereon, and further having a notch adjacent to the lower shoulder. The shoulders and the notch are configured for inserting into a mounting rail having slots therein. The mounting rail is adapted to mount to a wall.

Grove, U.S. Pat. No. 6,591,995 discloses a mounting system having brackets which are removably mounted in vertical mounting slots of a wall panel. The brackets are releasable from the mounting slots. The upper edge of the bracket defines an upper notch that is spaced from the first and second notches in the lower edge. The lower edge defines a first notch, formed intermediate to a first corner of the lower edge and a spaced second corner of the lower edge, and a spaced second notch, formed intermediate to the first notch and the second corner of the lower edge. The upper edge of the body of the bracket defines an upper notch that is spaced apart from the first and second notches in the lower edge.

Fox, U.S. Pat. No. 8,297,572 discloses a hanging fixture for a wall board having slots. The fixture has a pair of legs extending in one direction and at least one arm extending in the other direction, the pair of legs having an arcuate distal edge. The upper leg further includes a finger that defines a notch, the finger being operably configured to fit into a slot of the board. The fixture is inserted into the slot and rotated such that the arm starts at an upper position and is lowered to a position that is approximately perpendicular to the board. The fixture is locked by bending a portion of the restraining member into the recessed side wall space and is then achieved by downwardly rotating the fixture, until the guide member penetrates a downwardly spaced similar groove of the panel.

Although some conventional wall mounting systems can be generally effective for supporting items such as tools, they can have some drawbacks. For example, some brackets, after being inserted into the slots, tend to move side-to-side. Some brackets can easily dislodge from the mounting panel. In contrast to many wall mounting systems in the market today, the wall mounting system of the present invention is tightly secured to the slots in the wall panel. Also, in contrast to traditional peg board hooks which are inserted into peg board holes, the brackets of this invention are locked in place. The mounting assemblies and brackets of the present invention provide additional features, benefits and advantages as described further below.

SUMMARY OF THE INVENTION

The present invention provides releasable brackets that can fasten to a mounting panel (panels). The brackets may be inserted into vertical slots in the mounting panel. The mounting panel may be mounted to a wall. The brackets are securely fastened to the mounting panel but can be easily removed from the mounting panel. The brackets have an outwardly extending arm that may be used to support and hold various items such as hand tools, power tools, utensils, and the like. In one embodiment, a bracket includes an upper leg portion and a lower leg portion that are joined by a rear beam portion. The upper leg portion has an upper shoulder abutment and an upwardly extending finger, the upper shoulder abutment and finger forming an upper notch adapted to receive an upper edge of a slot on a mounting panel. This allows the upper leg portion to be rotated in a first direction as the bracket is inserted into the slot. The lower leg portion has a lower shoulder abutment and a downwardly extending intermediate body portion, the lower shoulder abutment and intermediate body portion forming a lower notch adapted to receive a lower edge of the slot so that the lower leg portion can rotate in the same first direction as the upper leg portion. The rear beam portion is deflected as the bracket is inserted into the slot and snaps back to a resting position as the bracket is locked in the slot.

In one embodiment, the mounting panel has an interior surface and exterior surface, and the upper shoulder abutment is pressed against the interior surface of the mounting panel when the bracket is locked in the slot.

In another embodiment, the lower leg portion has an intermediate body portion, and the intermediate body portion of the lower leg is pressed against the exterior surface of the mounting panel when the bracket is locked in the slot.

In yet another embodiment, the upper leg portion further includes an outwardly extending arm for supporting various articles as described further below. The support arm can include various shaped support members such as e.g., a hook support member or U-shaped support member, for supporting the articles.

The bracket can be made of any plastic, metal, or other suitable material. In one embodiment, the bracket is made of an elastic material, such as e.g., polyacrylonitrile butadiene styrene (ABS) or polylactic acid (PLA). Polymer blends such as ABS and polycarbonate (PC) may also be used. The brackets of the present invention can be used to support various articles including, e.g., combination wrenches, socket wrenches, socket rails, paint brushes, screwdrivers, plyers, channel locks, cutters, metal wires, rods, and the like.

In another embodiment, the wall mounting assembly includes: i) a panel for mounting on a wall, the panel having vertically extending slots, wherein the slots are adapted for receiving brackets; ii) a bracket for locking in a mounting panel having slots, the bracket including: iii) an upper leg portion and a lower leg portion that are joined by a rear beam portion. The upper leg portion has an upper shoulder abutment and an upwardly extending finger portion, wherein the upper shoulder abutment and finger portion form an upper notch adapted to receive an upper edge of a slot on a mounting panel so that the upper leg portion can rotate in a first direction as the bracket is inserted into the slot. The lower leg portion has a lower shoulder abutment and a downwardly extending intermediate body portion, wherein the lower shoulder abutment and intermediate body portion form a lower notch adapted to receive a lower edge of the slot so that the lower leg portion can rotate in the same first direction as the upper leg portion. The rear beam portion is deflected as the bracket is inserted into the slot and snaps back to its resting position as the bracket is locked in the slot.

BRIEF DESCRIPTION OF THE DRAWINGS

The novel features that are characteristic of the present invention are set forth in the appended claims. However, example embodiments of the present invention, together with attendant advantages, are best understood by reference to the following detailed description in connection with the accompanying drawings in which:

DETAILED DESCRIPTION OF THE INVENTION

Figure 1:
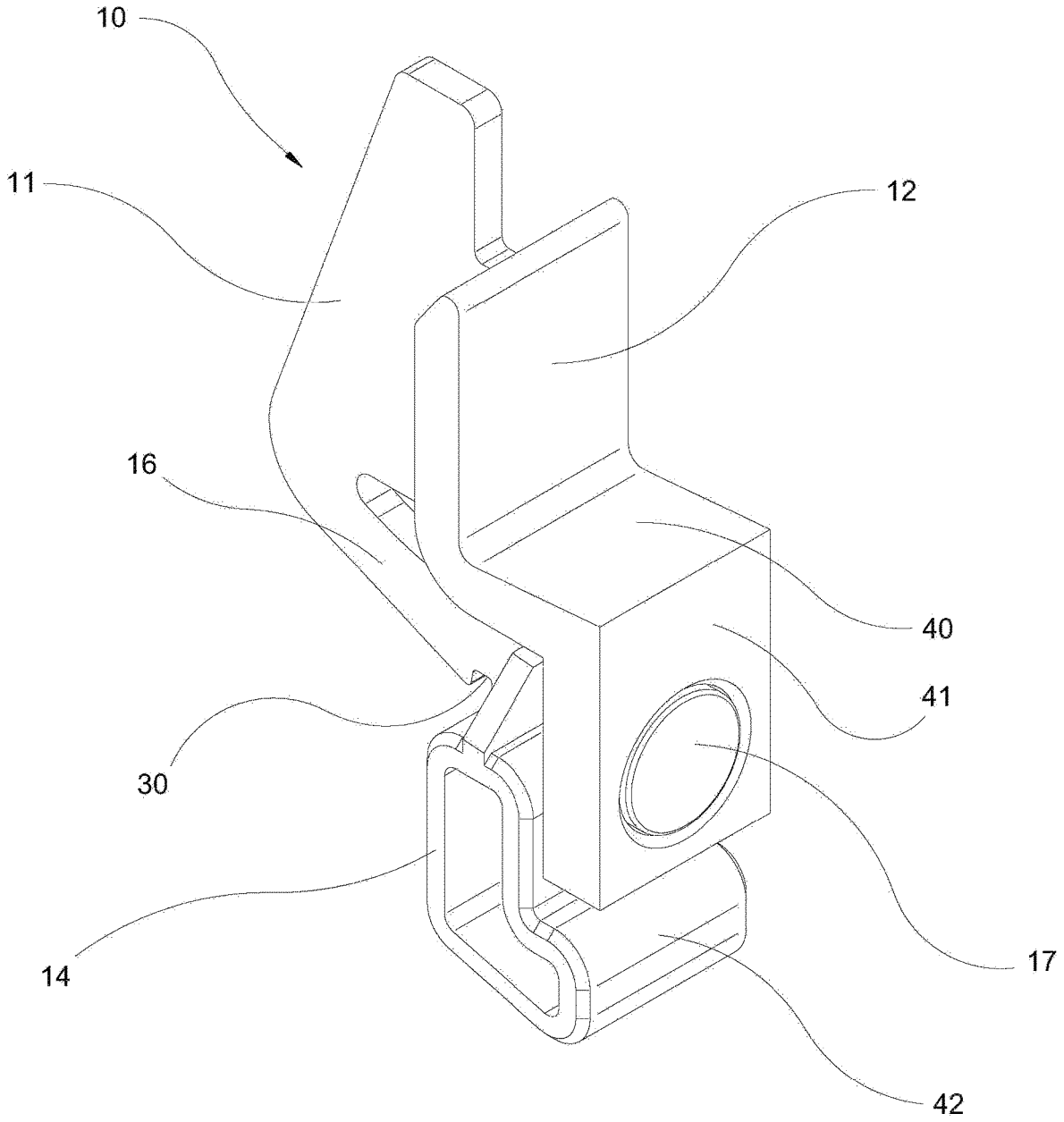
FIG. 1 is a perspective view of one embodiment of the bracket of the present invention.

In the Figures, like reference numerals are used to designate like elements.

Figure 2:
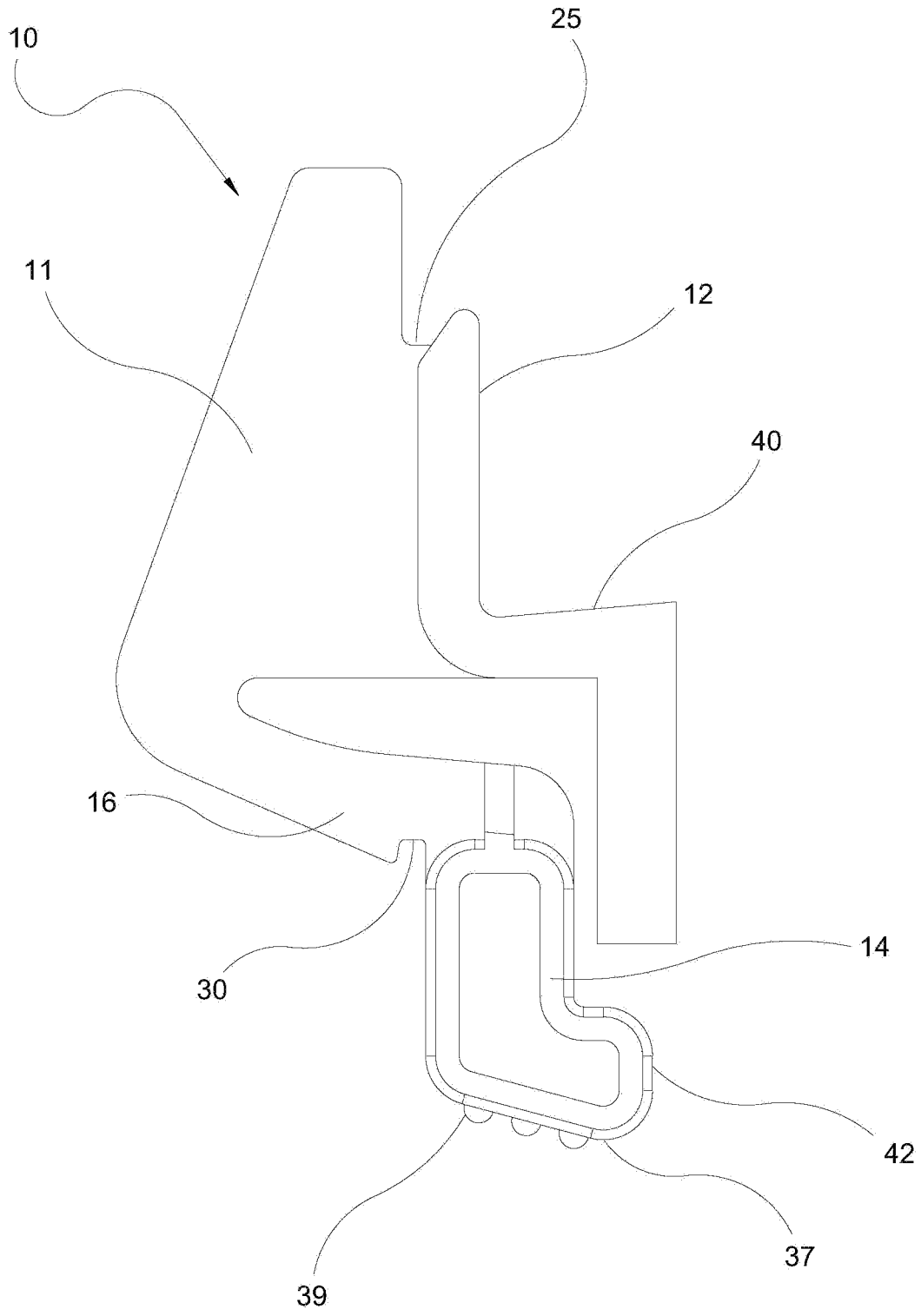
FIG. 2 is a side elevational view of the bracket show in FIG. 1.

Referring to FIGS. 1 and 2, one embodiment of a bracket (10) of the present invention is shown in perspective and side views, respectively. In one embodiment, the body of the bracket (10) is a one-piece integral unit. The bracket (10) may be made of plastic, metal, or other suitable material. In one embodiment the bracket mat be made of, or include, an elastic material, such as, e.g., poly(acrylonitrile butadiene styrene) (ABS) or poly(lactic acid) (PLA). Polymers such as polycarbonate (PC) also may be used. In one embodiment, the bracket (10) includes an upper leg portion (12) and a lower leg portion (14) that are joined by a rear beam portion (16). The bracket (10) may include a rear connecting member (11) that extends from the rear beam portion (16). In one embodiment, the rear beam portion (16) is elastically deformable such that the lower leg portion (14) can be moved, e.g., relative to the upper leg portion (12), and then can return to or towards a resting position.

Figure 3:
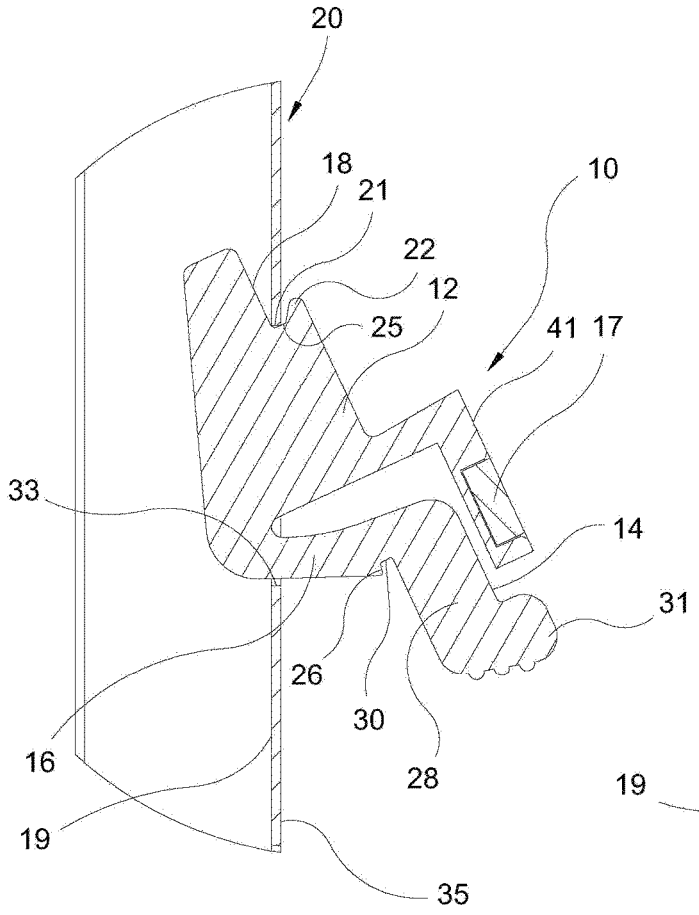
FIG. 3 is a cut-away view of the bracket shown in FIG. 1 being inserted into a mounting panel.
Figure 3A:
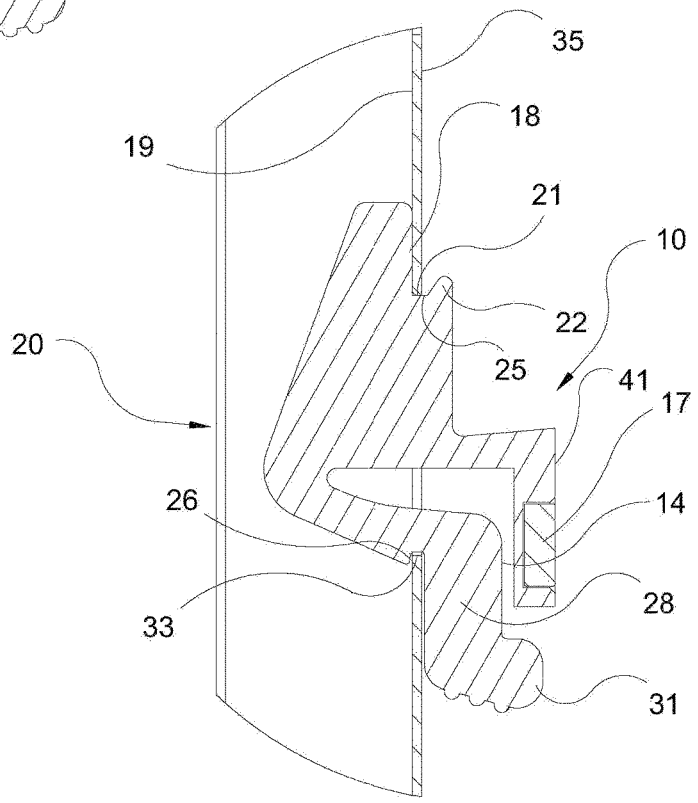
FIG. 3A is a cut-away view of the bracket shown in FIG. 3 showing the bracket in a locked position in the mounting panel.

In one embodiment, the bracket (10) can include two pieces. For example, there may be a first piece or main body member including the upper leg portion (12), lower leg portion (14), rear beam portion (16), rear connecting member (11), and support member as described further below. There may be a second piece such as a secured magnet (17) that may be held, e.g., in the upper leg portion (12) as shown in FIGS. 1 and 3 and 3A. Other examples of magnet pieces (17) are shown in 5A. In particular, the bracket (10) may include a panel (41). The panel (41) may include the magnet (17) attached to its outer surface in this embodiment. In addition, as discussed further below and shown in FIGS. 6 and 6A, in another example of a "two-piece" bracket, there may be a metal wire or rod hook member (59) embedded in, and extending from, the plastic main body member of the bracket (10). Because the metal rod member (59) is stiffer than plastic, it may support articles without significant deflection.

In the embodiment shown in FIGS. 1 and 2, the upper leg portion (12) further includes an outwardly extending upper arm (40). The lower leg portion (14) also may contain an outwardly extending lower arm (42). As discussed further below, different support members may be integrated or combined with the upper and/or lower arms (40, 42) for supporting and holding different tools and other objects. Thus, the bracket (10) may include an integrated support member (not shown in FIGS. 1 and 2). There are various support members that may be an integrated component of the bracket (10) as described and illustrated further below.

The rear beam portion (16) may be an intermediate segment extending between the upper and lower leg portions (12, 14). In one embodiment, the rear beam portion (16) is joined to the upper leg portion (12) by a rear connecting member (11). As shown in FIGS. 3 and 3A, the upper leg portion (12) includes an upper shoulder abutment (18) which may be shaped to contact the interior surface (19) of the mounting panel (20) when the bracket is fixed thereto. The upper leg portion (12) may include an upwardly extending finger portion (22), and the upper shoulder abutment (18) and finger portion (22) may define an upper notch (25) adapted for inserting into a slot (27) of the mounting panel (20). The upper shoulder abutment (18) may be shaped to press against the interior surface (19) of the mounting panel (20) when the bracket is locked into the slot (27) of the panel (20). This bracket locking step is described further below.

As further shown in FIGS. 3 and 3A, the lower leg portion (14) may include a lower shoulder abutment (26) and a lower intermediate body portion (28) that define a lower notch (30). In one embodiment, the lower intermediate body portion (28) is in the form of a finger portion analogous to the upper finger portion (22). The lower intermediate body portion (28) may be joined to a lower foot portion (31). In one embodiment, similar to the upper notch (25), the lower notch (30) is also adapted for inserting into the slot (27) of the mounting panel (20) as described further below.

In practice, to insert the bracket (10) into the slot (27) of the mounting panel (20), a person may grasp the bracket (10) with their thumb and index finger and squeezes the lower foot portion (31) to deform the rear beam portion (16) so that the bracket (10) can be easily fitted into the slot (27). Then, the person may press against the bracket (10) to push the bracket (10) into the slot (27) until it snaps in place in the slot (27). The bracket (10) may be made of, or include, an elastic material. Various polymers such as poly(acrylonitrile butadiene styrene) (ABS) and poly(lactic acid) (PLA) may be used to form the bracket. Polymers such as polycarbonate (PC) may also be used. Plastics or metals having different tensile strength, flex modulus, impact durability, and other properties may be used depending on the desired support strength of the bracket. In one embodiment, the rear beam portion (16) is formed of, or includes, and elastic material that allows the bracket (10), e.g., the rear beam portion (16) to elastically or reversibly bend as it is being inserted into the slot (27). When the rearward part of the bracket (10) is inserted into the slot (27) the rear beam portion (16) can be partially deflected, e.g., towards the upper arm (40). As shown in FIGS. 3 and 3A, the upper notch (25) of the bracket (10) makes contact with the upper edge (21) of the slot (27) so that the bracket (10) can rotate around this upper edge (21). The bracket (10) rotates in a first direction, e.g., clockwise in the side view presented in FIG. 3, as the bracket is inserted into the slot (27) and snaps into place.

As the bracket (10) snaps into the slot (27), the deflected rear beam portion (16) snaps back to (or towards) its original (or undeflected) position, e.g., so as to move away from the upper arm (40), to bring the lower notch (30) into contact with a lower edge (33) of the slot (27). In addition, the upper edge (21) of the slot (27) comes to rest against the seating surface of the upper notch (25). Furthermore, the upper shoulder abutment (18) is pressed flush against the interior surface (19) of the mounting panel (20) as shown in FIG. 3A. In this manner, the bracket (10) can lock into the mounting panel (20). The bracket (10) is securely fastened to the panel (20) and will not be easily dislodged. For example, the bracket (10) may remain securely fastened to the mounting panel (20) without the aid of gravity such the bracket could remain securely fastened to the mounting panel (20) even if the mounting panel (20) were to be inverted.

Likewise, as the bracket (10) is inserted into the slot (27), the lower notch (30) of the lower leg portion (14) makes contact with the lower edge (33) of the slot (27). The lower shoulder abutment (26) slides against the lower edge (33) of the slot (27). The bracket (10) snaps into place as the rear beam member (16) snaps back to (or towards) its original position and the seating surface of the lower notch (30) comes to rest against the lower edge (33) of the slot (27). That is, in locking the bracket (10) to the mounting panel (20), the lower leg portion (14) is rotated in the same first direction, e.g., clockwise in FIG. 3, as the upper leg portion (12). In this way, the intermediate body portion (28) of the lower leg portion (14) may also be pressed flush against the exterior surface (35) of the mounting panel (20) as also shown in FIG. 3A. Also, the panel-facing face of the upper leg (12) may be formed with a width that sits flush against the exterior surface (35) of the mounting panel (20), which may help form a more robust engagement of the bracket (10) with the exterior surface (35) of the mounting panel (20), thus, e.g., reducing or eliminating a tendency for side-to-side rocking of the bracket (10) while one hangs a tool thereon or removes a tool therefrom. The bracket may be formed with mounting panel (20)-facing surfaces (e.g., at the upper leg portion (12) and the lower leg portion (14)) that rest firmly against the mounting panel (20) when the upper notch (25) and the lower notch (30) are engaged with the corresponding ends of the slot (27). For example, the mounting panel (20)-facing surfaces (e.g., at the upper leg portion (12) and lower leg portion (14)) may be substantially coplanar when the rear beam portion (16) snaps back to (or towards) its original position, so as to rest firmly against the plane of the exterior surface (35) of the mounting panel (20).

Figure 4:
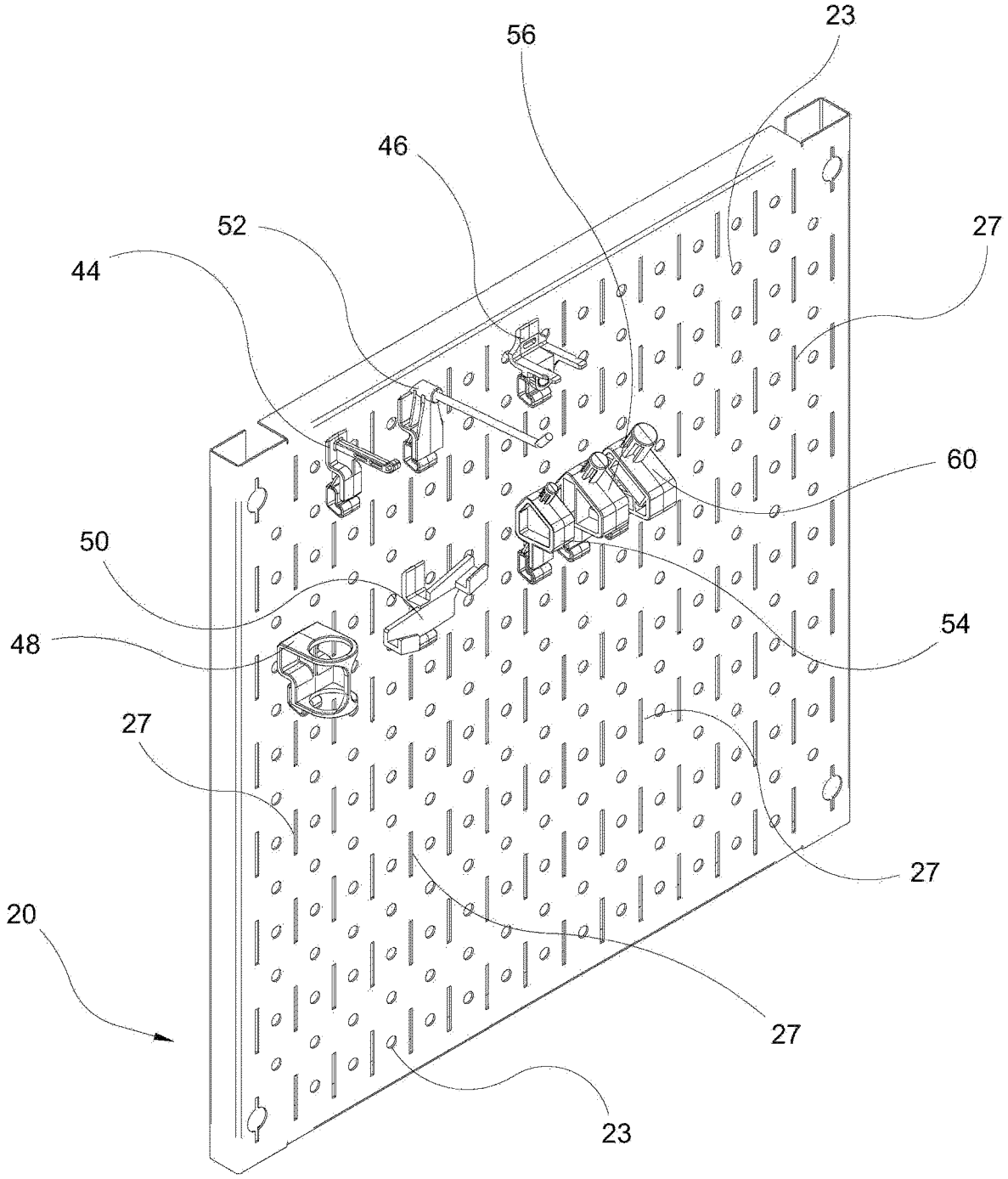
FIG. 4 is a perspective view of a mounting panel containing multiple vertical slots and multiple brackets inserted and locked in the slots.

Rotating the upper and lower leg portions (12, 14) of the bracket (10) in the same direction over the edges of the slot (27) as the bracket (10) is being inserted into the slot (27) is advantageous. It may allow for the bracket (10) to be snap-fitted into the slots (27). Furthermore, as described above, the elastic properties of the bracket (10) allow it to bend, e.g., elastically deform, while it is being inserted into the slot (27). The bracket (10) then snaps back, e.g., elastically restores, to its resting position, thus locking the bracket (10) in place. As shown in FIGS. 3A and 4, the bracket (10) is tightly and securely fitted in the slot (27) of the mounting panel (20).

As described above, the brackets (10) of the present invention can be inserted into the slot (27) of the mounting panel (20) and locked in place. Another advantage of the present invention is the brackets (10) may be easily removed from the mounting panel. In practice, the person may press their thumb upwardly against the bottom portion (37) of the lower leg portion (14). The bottom portion (37) may have small nubs (39) to provide a good gripping surface. This pressing action causes the rear beam portion (16) to deflect. The rear beam portion (16) is partially deformed as the lower leg (14) is pressed upwardly. The bracket (10) moves upwardly so the seating surface of the lower notch (30) disengages from, e.g., is no longer in contact with the lower edge (33) of the slot (27). That is, the bracket (10) is raised and cleared from the lower notch (30). The bracket (10) thus may move freely—it is no longer tightly secured to the mounting panel (20). The bracket (10) may be removed easily from the mounting panel (20).

As the bracket (10) is removed from the slot (27), the lower notch (30) is raised slightly so that it clears the lower edge (33) of the slot (27). Thus, the bracket is free to rotate, e.g., counter-clockwise in FIG. 3, around the upper edge (21) of the slot (27). Also, the upper notch (25) of the bracket (10) may be lowered slightly so that it clears the upper edge (21) of the slot (27). Removing the bracket requires a similar radial/rotational movement as installing the bracket, but removal happens in an opposing second direction versus the first direction used for installing the bracket.

As described above, the small nubs (39) may provide gripping surface to more easily allow the bracket (10) to be released by pressing the thumb or other finger on the grip and raising the bracket (10) past the lower notch (30). The angle of the bottom portion (37) may be such that it wedges the person's thumb/finger between the bracket (10) and mounting panel (20). This action may help disengage the bracket (10) from the slot (27).

The mounting panel (20), which may also be referred to as a board or mounting board, of the present invention may include a series of vertical slots (27). The panel (20) may also contain holes (23) to accept traditional aperture/peg board brackets. The panel (20) may contain any number of slots (27) or holes (23) and the slots/holes may be arranged in any suitable pattern, e.g., a geometric pattern. The mounting panel (20) is normally made of metal, and the slots (27) may have different dimensions for receiving different sizes of brackets (10) as discussed further below. The mounting board (20) may be mounted on a wall or other appropriate structure. The slots (27) may be adapted for receiving the brackets (10) of the present invention as described above.

As discussed above, the upper leg portion (12) of the bracket (10) includes the upper arm (40). The lower leg portion (14) may also contain the outwardly extending lower arm (42). Referring to FIGS. 5-5C, 6-6B and 7-7C, different support members are integrated with the upper arm (40) in order to support and hold different items. For example, referring to FIG. 5, this example shows an elongated hook support member (44) extending outwardly from the upper arm (40) of the bracket. The elongated hook support member (44) can be used for hanging articles such as, e.g., combination wrenches, paint brushes, and serving spoons.

Figure 5:
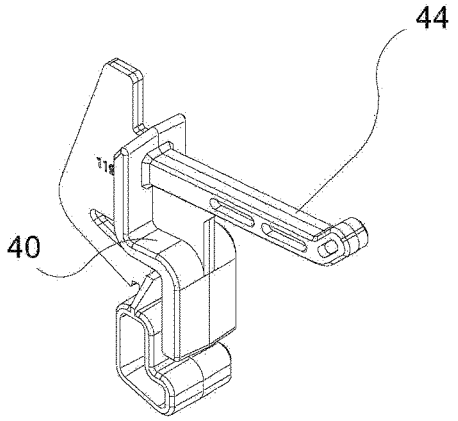
FIG. 5 is a perspective view of one embodiment of a bracket of the present invention showing an elongated hook member extending outwardly from the upper arm of the bracket.
Figure 5A:
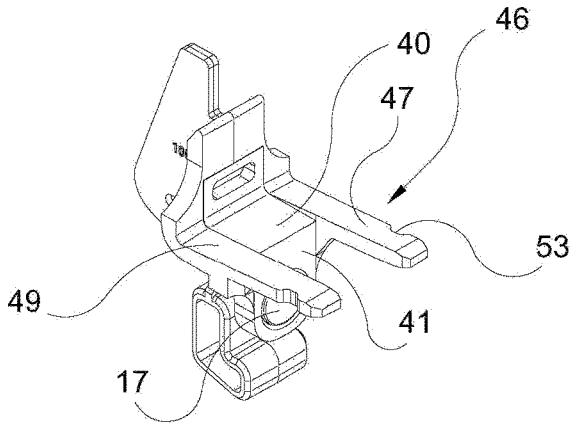
FIG. 5A is a perspective view of one embodiment of a bracket of the present invention showing a support member extending outwardly from the upper arm of the bracket and having a U-shaped cut-out portion that defines two projecting hook members containing notches.

In another example, as shown in FIG. 5A, the bracket (10) has a support member including an integrated U-shaped portion (46) having two projecting hook members (47, 49) (arms) containing notches (53). The notches (53) may be used to hold accessories (not shown). For example, an accessory protruding piece could be joined to the notched portion (53). The projecting hook members (47, 49) are joined by the outwardly extending upper arm (40) to define the U-shaped structure. The hook members (47, 49) may be used for supporting various items such as screwdrivers or other axial-handled articles. The handle of the article is supported by the two hooks (47, 49), while the magnet (17) attracts the shank of the article, thus holding it in place. This bracket (10) may also be used to hold locking plyers in an upside-down position.

Figure 5B:
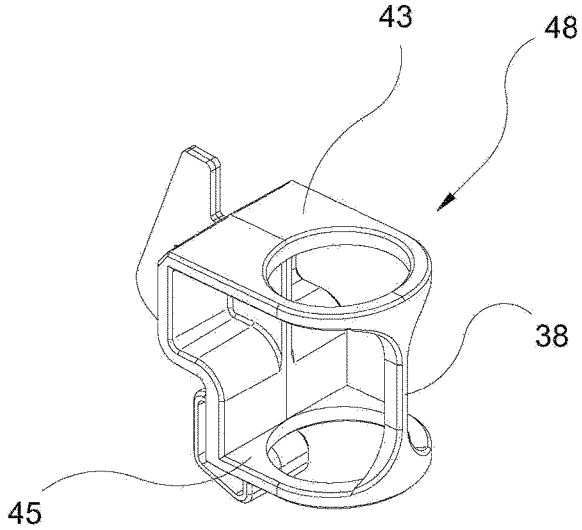
FIG. 5B is a perspective view of one embodiment of a bracket of the present invention showing a support member extending outwardly from the upper arm of the bracket and having upper and lower panels, wherein an intermediate panel joins the upper and lower panels, and the upper and lower panels have aligned circular apertures.

Referring to FIG. 5B, the bracket (10) has a support member (48) including an upper panel (43) and lower panel (45), wherein an intermediate panel (38) joins the upper and lower panels. In FIG. 5B, the intermediate panel (38) of the support member (48) has an "I-shaped" structure. The upper panel (43) has a circular aperture, and the lower panel (45) has a circular aperture. The apertures are aligned. This bracket (10) may be used for holding a variety of articles. For example, the bracket (10) can be used for supporting a two-handled articulated article such as plyers, channel locks, or cutters. One handle of the article slides through both holes. The bracket (10) may also support a scissor where the closed blades go through both holes and the handles of the scissor make contact with the top circle to prevent them from falling through.

Figure 5C:
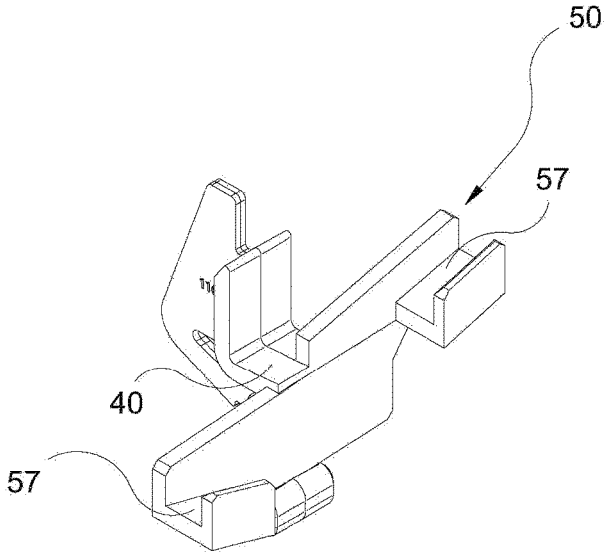
FIG. 5C is a perspective view of one embodiment of a bracket of the present invention suitable for holding digital or dial calipers, wherein the bracket has a caliper support member including U-shaped cut-out portions that define channeled or grooved segments for holding the caliper.

In FIG. 5C, a "caliper" bracket (10) having a caliper support member (50) including U-shaped cut-out portions that define channeled or grooved segments (57) is shown. The caliper support member (50) is designed for holding digital or dial calipers.

Figure 6:
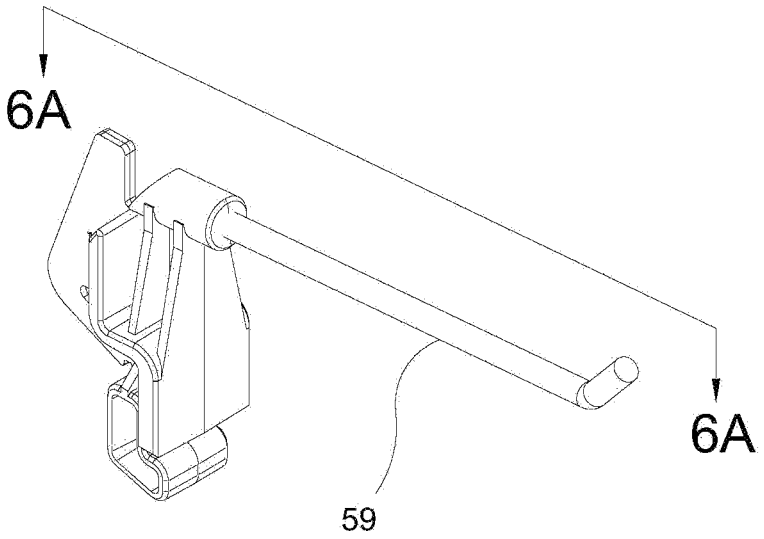
FIG. 6 is a perspective view of one embodiment of a bracket of the present invention showing an elongated hook member extending outwardly from the upper arm of the bracket, wherein one end of the hook member is inserted into a channel and the opposing end of the hook member is angled upwardly.
Figure 6A:
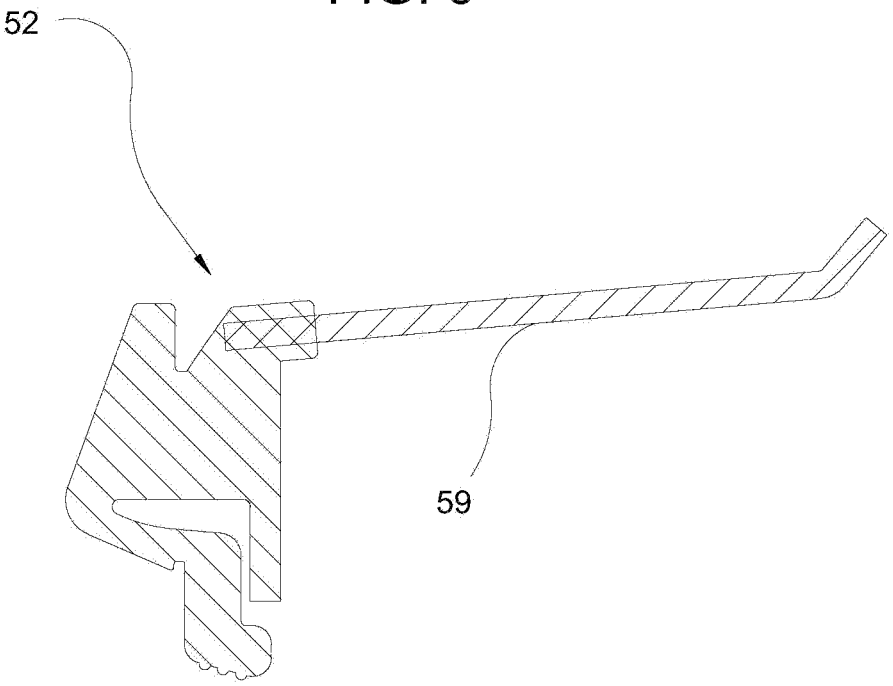
FIG. 6A is a cross-sectional view of the bracket and elongated hook member shown in FIG. 6.

Turning to FIGS. 6 and 6A, different views of a bracket (10) having a channeled portion (52) in the upper leg portion (12) for receiving an elongated hook member (59). The hook member (59), which is preferably a metal wire or rod, extends outwardly from the channeled portion (52). The hook member (59) can be made of any suitable material. For example, the hook member (59) can be a metal wire or rod. One end of the hook member (59) is inserted into the channel and the opposing and exposed end of the hook member is angled upwardly. The bracket (10) having the hook member (59), as shown in FIGS. 6 and 6A, is an example of a two-piece bracket. The hook member (59) can be used for supporting a wide variety of items including, but not limited to, advertising displays and retail items such as bagged merchandise with a punched hole, or tools such as a series of brushes with holes in their handles.

Figure 7:
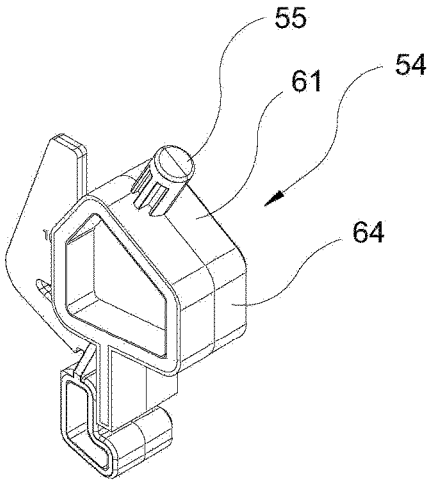
FIG. 7 is a perspective view of one embodiment of a bracket of the present invention suitable for holding various sizes of ¼-inch drive sockets, extensions, and adapters, wherein the bracket has a support member including an angled panel with a projecting knob that may be used for holding the socket.
Figure 7A:
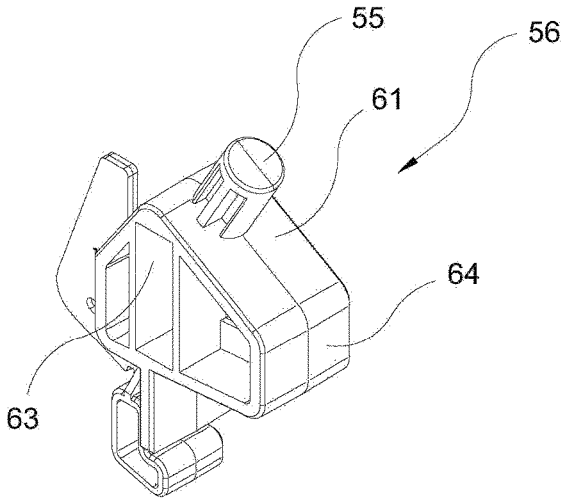
FIG. 7A is a perspective view of one embodiment of a bracket of the present invention suitable for holding various sizes of ⅜-inch drive sockets, extensions, and adapters, wherein the bracket has a support member including an angled panel with a projecting knob that may be used for holding the socket.
Figure 7B:
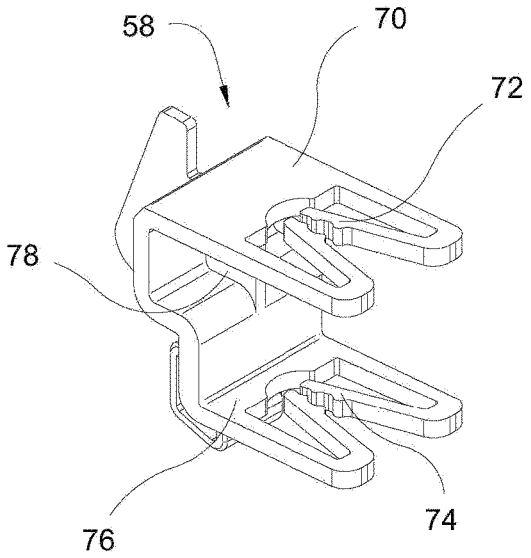
FIG. 7B is a perspective view of one embodiment of a bracket of the present invention showing a support member extending outwardly from the upper arm of the bracket and having upper and lower panels, wherein an intermediate panel joins the upper and lower panels, and the upper and lower panels have aligned V-shaped notches.
Figure 7C:
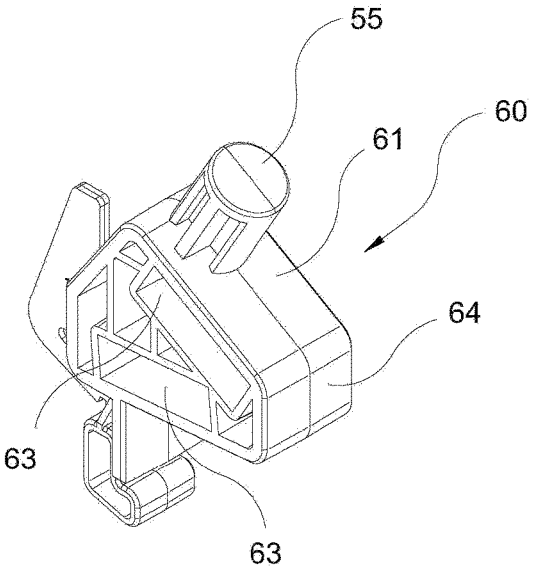
FIG. 7C is a perspective view of one embodiment of a bracket of the present invention suitable for holding various sizes of ½-inch drive sockets, extensions, and adapters, wherein the bracket has a support member including an angled panel with a projecting knob that may be used for holding the socket.

In FIGS. 7-7C, different support members are shown extending outwardly from the upper arm (40) of the bracket (10). In FIG. 7, a "one-quarter (¼) inch drive socket" bracket (10) having a support member (54) including an angled panel (61) with a projecting knob (55) that can be used for supporting a socket is shown. A vertical flat panel (64) is shown extending downwardly from the angled panel (61), onto which a size-indicating decal can be affixed. The one-quarter (¼) inch drive socket bracket (10) shown in FIG. 7 is ideal for holding various sizes of ¼-inch drive sockets, extensions, and adapters.

In FIG. 7A, a "three-eighth (⅜) inch drive socket" bracket (10) having a support member (56) including an angled panel (61) with a projecting knob (55) that can be used for supporting a socket, and a vertical flat panel (64), onto which a size-indicating decal can be affixed is shown. The three-eighth (⅜) inch drive socket bracket (10) shown in FIG. 7A is ideal for holding various sized ⅜-inch drive sockets, extensions, and adapters. Each side of the support member (56) has at least one open side pocket (63). The side pocket (63) can accept the complementary end of a horizontally-extending segment (rail) (not shown) for retaining sockets. In this way, two brackets (10) having support members (56) can be mounted side-by-side on the mounting panel (20), and a socket rail can extend horizontally between the respective brackets. The socket rail can be held in place by the side pockets (63) of the respective support members (56). More particularly, the socket rail can have a first end that is press-fitted into a recess of the side pocket (63) of a first support member (56); and an opposing second end that is press-fitted into a recess of the pocket (63) of a second support member (56).

Turning to FIG. 7B, the support member (58) is shown extending outwardly from the upper arm of the bracket (10). The support member (58) has upper (70) and lower (76) panels, wherein an intermediate panel (78) joins the upper and lower panels, and the upper and lower panels have upper (72) and lower (74) V-shaped notches that are aligned with each other. The bracket (10) having integrated support member (58) can be used for supporting a single combination wrench and various other tools and articles. The two sets of arms including the upper (72) and lower (74) notches deflect and grip the wrench as it is inserted. The upper and lower notches (72, 74) can have serrated teeth to better grip the tool or other item.

In FIG. 7C, a "one-half (½) inch drive socket" bracket (10) having a support member (60) including an angled panel with a projecting knob (55) that can be used for supporting a socket, and a vertical flat panel (64), onto which a size-indicating decal can be affixed is shown. The one-half (½) inch drive socket bracket (10) shown in FIG. 7C is ideal for holding various sizes of ½-inch drive sockets, extensions, and adapters. Each side of the support members (60) has one or more open side pockets (63). The side pocket (63) can accept the complementary end of a horizontally-extending segment (rail) (not shown) for retaining sockets. In this way, two brackets (10) having support members (60) can be mounted side-by-side on the mounting wall (20), and a socket rail can extend horizontally between the respective brackets.

The support member of the present invention can be used for supporting and holding various objects such as, e.g., hand tools such as socket rails and rachets, calipers, wrenches, screwdrivers, hammers, pliers, cutters, power tools, lawn and garden supplies, sports equipment, utensils, kitchen tools and gadgets, arts and crafts supplies, office supplies, retail displays and advertising, and the like.

The reference (call-out) numbers and corresponding elements as described above are summarized in below Table 1.

TABLE 1

| Reference Number | Element |
|---|---|
| 10 | Bracket |
| 11 | Rear connecting member |
| 12 | Upper leg portion |
| 14 | Lower leg portion |
| 16 | Rear beam portion |
| 17 | Secured magnet |
| 18 | Upper rear shoulder abutment |
| 19 | Interior surface of panel |
| 20 | Panel |
| 21 | Upper edge |
| 22 | Upwardly extending finger portion |
| 23 | Hole |
| 25 | Upper notch |
| 26 | Lower shoulder abutment |
| 27 | Slot |
| 28 | Lower intermediate portion |
| 30 | Lower notch |
| 31 | Lower foot portion |
| 33 | Lower edge |
| 35 | Exterior surface of the panel |
| 37 | Bottom portion |
| 38 | Intermediate panel |
| 39 | Small nubs |
| 40 | Outwardly extending upper arm |
| 41 | Panel extending downwardly |
| 42 | Outwardly extending lower arm |
| 43 | Upper panel |
| 44 | Elongated hook support member |
| 45 | Lower panel |
| 46 | Support member (Screwdriver bracket) |
| 47 | Hook member |
| 48 | Support member (Plier's bracket) |
| 49 | Hook member |
| 50 | Support member (Caliper bracket) |
| 52 | Channeled portion |
| 53 | Notches |
| 54 | Support member (¼ drive socket bracket) |
| 55 | Projecting nob |
| 56 | Support member (⅜ drive socket bracket) |
| 57 | Grooved segments |
| 58 | Support member (wrench) |
| 59 | Metal rod |
| 60 | Support member (½ drive socket bracket) |
| 61 | Angled panel |
| 63 | Pocket |
| 64 | Vertical flat panel |
| 70 | Upper panel |
| 72 | Upper V-notch |
| 74 | Lower V-notch |
| 76 | Lower panel |
| 78 | Intermediate panel |

It should be understood the terms, "first", "second", "top", "bottom", "above", "below", "upper", "lower", "intermediate", "upwardly", "downwardly", "right", "left", "anterior", "posterior", and the like are arbitrary terms used to refer to one position of an element based on one perspective and should not be construed as limiting the scope of the present invention.

It also should be understood that the mounting panels, brackets, systems, assemblies, constructions, materials, and the like described and illustrated herein represent only some embodiments of the present invention. It is appreciated by those skilled in the art that various changes and additions can be made to the mounting boards, brackets, systems, assemblies, constructions, materials, and the like herein without departing from the spirit and scope of the present invention. It is intended that all such embodiments be covered by the appended claims.

What is claimed is:

1. A bracket for locking in a mounting panel having a slot, the bracket comprising:

an upper leg portion and a lower leg portion that are joined by a rear beam portion;

the upper leg portion having an upper shoulder abutment and an upwardly extending finger portion, the upper shoulder abutment and finger portion forming an upper notch adapted to receive an upper edge of the slot on the mounting panel so that the upper leg portion can rotate in a first direction as the bracket is inserted into the slot;

the lower leg portion having a lower shoulder abutment and a downwardly extending intermediate body portion, the lower shoulder abutment and intermediate body portion forming a lower notch adapted to receive a lower edge of the slot so that the lower leg portion can rotate in the same first direction as the upper leg portion; and the rear beam portion being deflected as the bracket is inserted into the slot and snapping back to its resting position as the bracket is locked in the slot.

2. The bracket of claim 1, wherein the mounting panel has an interior surface and an exterior surface, and the upper shoulder abutment is pressed against the interior surface of the mounting panel when the bracket is locked in the slot.

3. The bracket of claim 2, wherein the lower leg portion has an intermediate body portion, and the intermediate body portion of the lower leg portion is pressed against the exterior surface of the mounting panel when the bracket is locked in the slot.

4. The bracket of claim 1, wherein the bracket is made of an elastic material.

5. The bracket of claim 1, wherein the upper leg portion further includes an outwardly extending upper arm for supporting an article.

6. The bracket of claim 5, wherein the upper arm includes a hook support member for supporting the article.

7. The bracket of claim 5, wherein the upper arm includes a U-shaped support member for supporting the article.

8. The bracket of claim 5, wherein the upper leg portion includes a channeled portion for retaining a hook support member, the hook support member extending outwardly from the upper leg portion for supporting the article.

9. The bracket of claim 1, wherein the rear beam portion is joined to the upper leg portion by a rear connecting member.

10. The bracket of claim 1, wherein:

the upper leg portion further includes an outwardly extending upper arm for supporting an article, and the upper arm includes a panel extending downwardly therefrom and a magnet is attached to the panel.

11. A wall mounting system, comprising a mounting panel for mounting on a wall, the mounting panel having a plurality of slots that extend vertically and are adapted for receiving brackets;

a bracket for locking in a first slot of the plurality of slots, the bracket including:

an upper leg portion and a lower leg portion that are joined by a rear beam portion;

the upper leg portion having an upper shoulder abutment and an upwardly extending finger portion, the upper shoulder abutment and the finger portion forming an upper notch adapted to receive an upper edge of the first slot of the mounting panel so that the upper leg portion can rotate in a first direction as the bracket is inserted into the first slot;

the lower leg portion having a lower shoulder abutment and a downwardly extending intermediate body portion, the lower shoulder abutment and intermediate body portion forming a lower notch adapted to receive a lower edge of the first slot so that the lower leg portion can rotate in the same first direction as the upper leg portion; and the rear beam portion being deflected as the bracket is inserted into the first slot and snapping back to its resting position as the bracket is locked in the first slot.

12. The wall mounting system of claim 11, wherein the mounting panel has an interior surface and an exterior surface, and the upper shoulder abutment is pressed against the interior surface of the mounting panel when the bracket is locked in the first slot.

13. The wall mounting system of claim 12, wherein the lower leg portion has an intermediate body portion, and the intermediate body portion of the lower leg portion is pressed against the exterior surface of the mounting panel when the bracket is locked in the first slot.

14. The wall mounting system of claim 11, wherein the upper leg portion of the bracket further includes an outwardly extending upper arm for supporting an article.

15. A bracket for locking in a slot of a mounting panel, the bracket comprising:

a first leg portion having a first shoulder abutment and a first finger portion, the first shoulder abutment and the first finger portion having a first notch therebetween, the first notch being adapted to receive a first end of the slot;

a second leg portion having a second shoulder abutment and a second finger portion, the second shoulder abutment and the second finger portion having a second notch therebetween, the second notch being adapted to receive a second end of the slot, opposite the first end of the slot; and a rear beam portion that joins the first leg portion to the second leg portion, the rear beam portion being adapted to elastically deflect such that a distance between the first notch and the second notch can vary when the rear beam portion deflects, the rear beam portion being elastically deflectable to reduce the distance when the bracket is inserted into the slot and to increase the distance when the rear beam portion returns toward a resting position as the bracket is locked in the slot.

* * * * *